United States Patent [19]

Roberts et al.

[11] 4,255,278

[45] Mar. 10, 1981

[54] PARTIAL OXIDATION PROCESS WITH RECOVERY OF UNCONVERTED SOLID FUEL FROM SUSPENSION IN WATER

[75] Inventors: Roy D. Roberts, Lakewood; George N. Richter, San Marino, both of Calif.

[73] Assignee: Texaco Inc., White Plains, N.Y.

[21] Appl. No.: 52,715

[22] Filed: Jun. 28, 1979

Related U.S. Application Data

[63] Continuation of Ser. No. 921,416, Jul. 3, 1978, abandoned.

[51] Int. Cl.[3] ..... C10J 3/46; C10K 1/02; C10K 1/10

[52] U.S. Cl. ..... 252/373; 48/197 R; 55/228; 209/2

[58] Field of Search ..... 48/197 R, 202, 206, 48/215; 252/373; 209/2, 17, 211; 55/228; 201/38

[56] References Cited

U.S. PATENT DOCUMENTS

| | | | |
|---|---|---|---|
| 2,970,689 | 2/1961 | Chang et al. | 209/211 |
| 3,976,443 | 8/1976 | Paull et al. | 48/197 R |
| 4,074,981 | 2/1978 | Slater | 252/373 |

OTHER PUBLICATIONS

Chemical Engineers Handbook, 4th Edition, Perry, pp. 19-87, 19-86, 1963.

*Primary Examiner*—Peter F. Kratz
*Attorney, Agent, or Firm*—Carl G. Ries; Robert Knox, Jr.

[57] ABSTRACT

Disclosed is a partial oxidation process including separation of particles high in carbon content from particles low in carbon content suspended in water used for quenching or scrubbing the gaseous products of the partial oxidation of a solid ash-containing carbonaceous fuel.

4 Claims, No Drawings

PARTIAL OXIDATION PROCESS WITH RECOVERY OF UNCONVERTED SOLID FUEL FROM SUSPENSION IN WATER

This is a continuation, of application Ser. No. 921,416, filed July 3, 1978, now abandoned.

This invention relates to the gasification of solid fuels. More particularly, it is concerned with the separation of ash and ungasified solid fuel from the products of gasification or partial combustion and the return of the ungasified solid fuel to the gasification zone where with additional fresh solid fuel it is subjected to partial oxidation.

Ordinarily in the gasification of solid fuel such as coal or coke, the fuel is subjected to partial oxidation with an oxidizing agent such as air, oxygen-enriched air or substantially pure oxygen (95%+) in a gasification zone with the production of a gas composed principally of carbon monoxide and hydrogen and also containing minor amounts of $CO_2$, $CH_4$, $H_2S$ and COS. Since insufficient oxygen is introduced into the gasification zone for complete oxidation of the carbon in the solid fuel, some of the solid fuel will proceed through the gasification zone without being converted to an oxide of carbon. When a hydrocarbon liquid is subjected to partial oxidation the unconverted carbon appears in the product gas as fine particles of soot whereas when a solid fuel is subjected to partial oxidation, the unconverted carbon appears in the product as fine particles of solid fuel. In addition, depending on the type of solid fuel feed, ash will also appear in varying amounts in the combustion products.

To cool the hot products of partial oxidation leaving the gas generation zone usually at a temperature above about 1800° F. and to remove particles of ash and unconverted solid fuel entrained therein, the hot gas is generally contacted with a quench medium, preferably water, in a quench zone whereby the gas is cooled and entrained particles are transferred to the quench medium. The larger particles of ash or slag which are low in carbon settle to the bottom of the quench zone and are removed therefrom but the finer particles form a suspension in the quench medium. To control the concentration of solid material in the quench medium, a portion is withdrawn continuously or periodically and is replaced with fresh quench medium. For economic and ecological reasons, it is desirable to separate material low in carbon from material high in carbn and to reuse the quench water and unconsumed fuel.

As mentioned above, when the feed to the gas generation zone is a hydrocarbn liquid, the unconverted carbon appears as fine particles of soot which are microscopic in size whereas when the feed to the gas generation zone is a solid fuel the unconverted carbon is in the form of discrete particles of solid fuel. The soot formed in the gasification of a hydrocarbon liquid may be recovered from suspension in the quench water by admixture with a hydrocarbon liquid as disclosed in U.S. Pat. No. 2,992,906 issued July 18, 1961 to F. E. Guptill, Jr. and U.S. Pat. No. 3,917,569 issued Nov. 4, 1975 to G. N. Richter, W. L. Slater, E. T. Child and J. C. Ahlborn. Unfortunately, the unconverted particles of solid fuel do not have the affinity for hydrocarbon liquids as do the soot particles formed by the partial combustion of a liquid fuel and the separation technique used for soot recovery is unsatisfactory for the recovery of unconverted solid fuel particles from the quench water.

Generally speaking, two methods are used for the gasification of solid fuel, one being operation of the gasifier in the fly ash mode and the other in the slagging mode. In the operation of the first type, the generator is maintained at a temperature at which the ash remains substantially solid whereas in the latter type the temperature of the gasifier is sufficiently high for the ash to be in molten state. Ordinarily when the operation is in the fly ash mode, the temperature is in the lower operating range and there is a low conversion of the carbon. The unconverted fuel and ash particles appear in the synthesis gas product as finely-divided fly ash. The economic feasibility of this type of operation requires that some of the unconverted carbon be recovered and be recycled back to the gasifier for a more complete utilization of the carbon in the fuel.

It is therefore an object of this invention to separate ash from unconverted solid fuel producted by the gasification of the solid fuel in the fly ash mode. Another object is to obtain a high overall conversion of the carbon in the solid fuel. Still another object is to minimize the amount of waste material which must be disposed of. These and other objects will be obvious to those skilled in the art from the following disclosure.

According to our invention, there is provided a process for the separation of particles having a high carbon content from particles having a low carbon content, said particles being suspended in water which process comprises separating said suspension by gravity into particles high in carbon content and a dilute suspension of particles low in carbon content.

The feed to the process of our invention comprises any solid carbonaceous fuel containing ash-forming ingredients such as coal, sub-bituminous coal, lignite, petroleum coke, organic waste and the like.

The solid fuel in finely-divided form, preferably ground to a particle size having a maximum cross-sectional dimension not greater than ¼ inch and still more preferably ground so that at least 90% passes through a 14 mesh sieve (U.S. Standard) is introduced into the gas generatin zone where it is reacted with steam and oxygen. The oxygen may be in the form of air, oxygen-enriched air or substantially pure oxygen. The finely-divided fuel may be introduced into the gas generation zone as a slurry in water or oil or as a suspension in a gaseous or vaporous medium such as steam, $CO_2$ and mixtures thereof. In the gas generation zone, the solid fuel is subjected to partial oxidation at a temperature between about 1800° F. and at least about 50° F. below the initial deformation temperature of the ash which, depending on the type of solid fuel feed, may range between about 2000° F. and 2500° F. The pressure in the gas generation zone may range between about 40 and 3000 psig or higher, preferably between about 60 and 2500 psig. The oxygen may be introduced into the gasification zone at an oxygen: carbon atomic ratio of between about 0.7 and 1.1 preferably between 0.8 and 1.0. When the solid fuel is introduced into the gasification zone as a slurry in water, advantageously the slurry should contain not more than 50 wt.% as a water content above that value will affect the thermal efficiency of the reaction. Good results are obtained using a water-to-fuel weight ratio between 0.3 and 1 preferably between about 0.4 and 0.9.

In a preferred embodiment the hot product gas containing entrained particles of ash and unconverted solid fuel is passed downwardly through a bottom outlet of the gasification chamber and into a quench chamber containing water. The hot gases are discharged through a dispersing device such as a dip tube with a serrated lower edge, under the surface of the quench water and thereby cooled. In the process, the entrained particles are wetted by the water and are transferred to suspension in the quench medium. To provide for the removal of a few of the more dense solid particles which are very high in ash and which do not remain in suspension in the quench water despite the agitation supplied by the introduction of the product gases under its surface, an outlet is provided at the bottom of the quench chamber for the removal of these larger, denser particles. Preferably such particles are removed periodically by means of a lock hopper connected to the bottom outlet whereby no loss in pressure is incurred during their removal.

The remaining particles of ash and unconverted fuel remain suspended in the quench medium. Actually there are few particles present which are purely carbon or purely ash so that they may more accurately be categorized as high in carbon content and low in carbon content. In this respect particles having a carbon content in excess of 33 weight % are considered as having a high carbon content whereas particles having a carbon content less than 33 weight % are considered as having a low carbon content.

The separation of the particles high in carbon content from the particles low in carbon content is effected by gravity. Surprisingly, it has been found that, although the particles high in carbon content are less dense than the particles low in carbon content, when subjected to gravitational force, it is the more dense particles, low in carbon, which are retained in the aqueous phase while the carbon-rich particles settle. This phenomenon seems to be peculiar to particles formed during the gasification of the solid fuel in the fly ash mode as particles produced by gasification of the solid fuel in the slagging mode behave in the expected manner, that is, that the more dense low carbon content particles settle faster than the high carbon low ash content particles.

In a preferred embodiment, the suspension of particles of unconverted solid fuel in water is screened through a 14 mesh sieve to remove any large particles of material and is then pumped to a continuous centrifuge where a carbon rich cake is separated from a suspension of the more dense low carbon particles.

Although the separation may be made at ambient conditions, it is more practical to apply a gravitational force in excess of 1 to the suspension. Gravitational forces of from 10 to 1000 G's may be used with from 100 to 800 being preferred. The resulting cake may be recycled to the partial oxidation zone.

The following example is submitted for illustrative purposes only and it should not be construed that the invention is restricted thereto. Gasifier operation is in the fly-ash mode.

EXAMPLE

The feed in this example is a Lake De Smet coal having the following moisture-free analysis:

TABLE 1

| | |
|---|---|
| Carbon | 51.82 wt. % |
| Hydrogen | 3.92 wt. % |
| Nitrogen | 0.68 wt. % |
| Sulfur | 1.20 wt. % |
| Oxygen | 15.90 wt. % |
| Ash | 26.48 wt. % |

The coal, ground so that 100% passes through a 14 mesh sieve, is slurried with an equal weight of water and, with pure oxygen at an oxygen:carbon atomic ratio of 0.859, is introduced into a gasifier which is maintained at a temperature of 1800° F. and a pressure of 350 psig. The product gas containing entrained fly ash is quenched in water to form a cooled product gas and a suspension of fly ash in the quench water. The product gas has the following composition on a mol % basis:

TABLE 2

| | |
|---|---|
| CO | 11.68 |
| $H_2$ | 18.79 |
| $CO_2$ | 20.10 |
| $H_2O$ | 45.59 |
| $CH_4$ | 3.26 |
| $N_2$ | 0.23 |
| $H_2S$ | 0.34 |
| COS | 0.01 |

The suspension, containing 14.9 wt. % solids analyzing 22.75% carbon and 77.25 wt. % ash, is introduced into a continuous centrifuge (model LB224 manufactured by Bird Machine Co. Inc. of South Walpole, Mass.) where it is subjected to a gravitational force of 570 G's. This treatment produces a centrifuge cake containing 66 wt. % solids analyzing 66.8 wt. % carbon and 33.2 wt. % ash and a fineswater suspension containing 12 wt. % solids analyzing 9.01 wt. % carbon and 90.99% ash.

The above operation represents an 85% carbon conversion. However, with recycle of the centrifuge cake and its introduction with fresh feed to the gasifier, the overall carbon conversion is increased to 94.9%.

EXAMPLE II

In this example, a sample of the suspension of Example I is subjected to a sink-float test in a mixture of halogenated hydrocarbons having a specific gravity of 1.3.

After standing for two hours, the floating portion is separated and both portions are filtered and dried. The carbon content of the sink portion is 83 wt. % while that of the float portion is 30.5 wt. %.

This example shows that even at ambient conditions, the less dense high carbon content particles settle before the more dense, high ash particles.

Although the examples show our invention as applied to the recovery of particles formed by the quenching of synthesis gas produced by the partial oxidation of coal slurried in water, it is equally applicable to the separation of particles suspended in water which has been used for the quenching or scrubbing of synthesis gas produced by the partial oxidation of other ash-containing carbonaceous fuels introduced into the partial oxidation zone as a suspension in water or in a hydrocarbon oil or in a vaporous or gaseous medium.

Various modifications of the invention as hereinbefore set forth may be made without departing from the spirit and scope thereof, and therefore, only such limitations should be made as are indicated in the appended claims.

We claim:

1. A partial oxidation process with the separation of particles having a high carbon content from particles having a low carbon content, said particles being suspended in water, said suspension being produced by passing downwardly through the bottom outlet of a partial oxidation zone into a quench chamber containing water, gas containing entrained particles of ash and unconverted solid fuel, producing said gas by the partial oxidation in the fly ash mode of a fresh feed of solid ash-containing carbonaceous fuel in said partial oxidation zone, screening said suspension to remove large particles of materials, separating said screened suspension by subjecting same in a continuous centrifuge to a gravitational force between 10 and 1000 G's into a cake portion containing particles high in carbon content and a dilute water suspension of particles low in carbon content and recycling the centrifuge cake and introducing it with said fresh feed into the partial oxidation zone to provide for increased carbon conversion.

2. The process of claim 1 in which the gravitational force is between 100 and 800 G's.

3. The process of claim 1 in which the solid ash-containing carbonaceous fuel is ground so that at least 90% passes through a 14 mesh sieve.

4. The process of claim 1 in which the suspension is screened through a 14 mesh sieve.

* * * * *